United States Patent [19]

Kauffman

[11] 4,291,607

[45] Sep. 29, 1981

[54] FLOATING BRIDGE FOR STRING INSTRUMENTS

[75] Inventor: Clayton O. Kauffman, Santa Ana, Calif.

[73] Assignee: James Ketchum, Anaheim, Calif.

[21] Appl. No.: 157,236

[22] Filed: Jun. 6, 1980

[51] Int. Cl.[3] ..... G10D 3/04

[52] U.S. Cl. ..... 84/299; 84/308

[58] Field of Search ..... 84/298, 299, 307, 308, 84/313, 314 N

[56] References Cited

U.S. PATENT DOCUMENTS

| | | | |
|---|---|---|---|
| 1,365,839 | 1/1921 | McHugh et al. | 84/307 |
| 2,491,991 | 12/1949 | Lundback | 84/307 |
| 2,786,382 | 3/1957 | Melita | 84/307 |
| 3,605,545 | 9/1971 | Rendell | 84/307 |
| 4,171,661 | 10/1979 | Rose | 84/314 N |

*Primary Examiner*—L. T. Hix
*Assistant Examiner*—Alan Mathews
*Attorney, Agent, or Firm*—Francis X. LoJacono

[57] ABSTRACT

A floating bridge for string instruments arranged to generate a higher volume of responsive resonated sound, the floating bridge being mounted to a thin flexible wall of the instrument's resonant body, and the wall defining a flexible diaphragm. The bridge is secured to the associated strings and includes a bridge block having a clamping bar to hold each string in a fixed juxtaposed relation to the others, whereby the vibration of each string is transferred through the bridge and bridge-supporting post, or posts, so that the bridge is not subjected to the longitudinal tension of the strings, allowing the resultant vibrations therefrom to propagate to the hollow body of the instrument, without obstruction thereto.

8 Claims, 11 Drawing Figures

FIG. 1
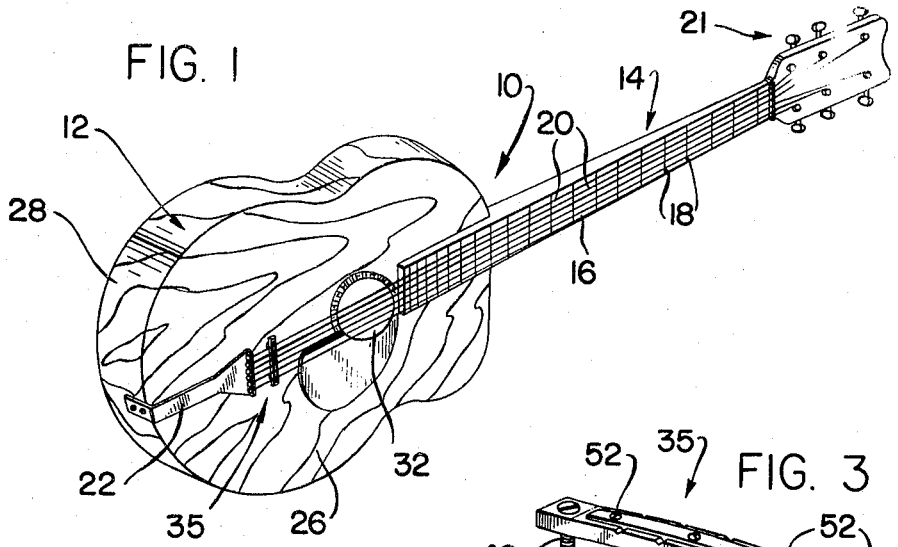
FIG. 3
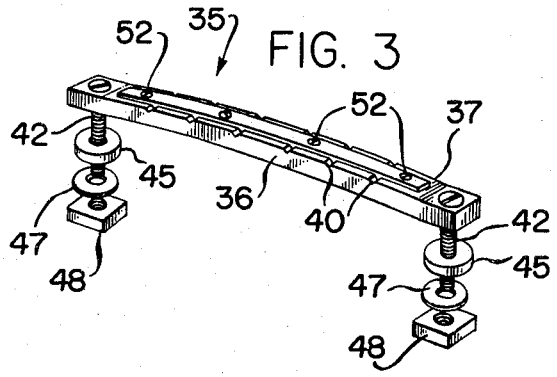
FIG. 2
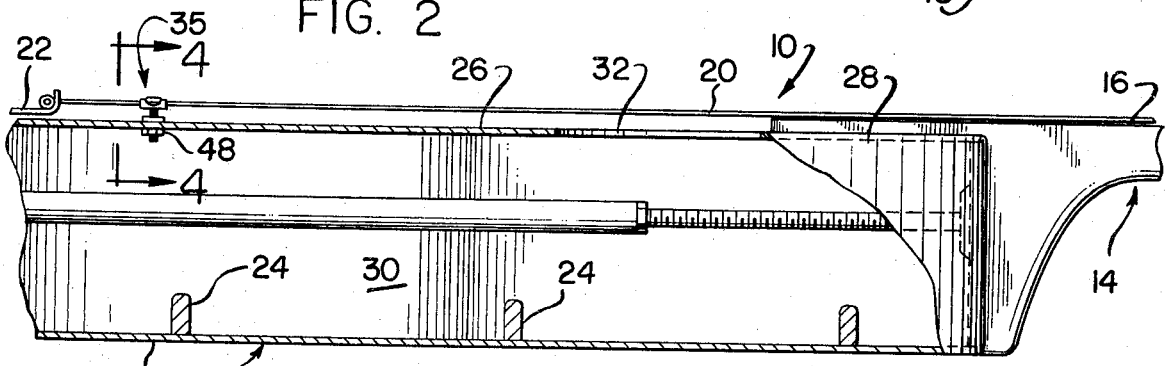
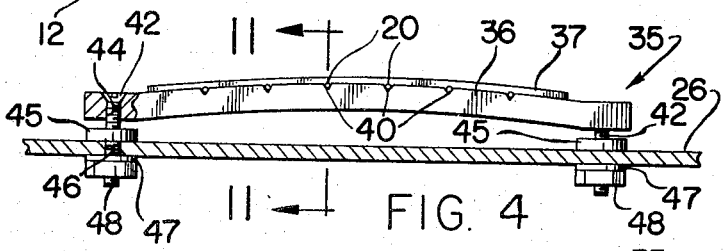
FIG. 4
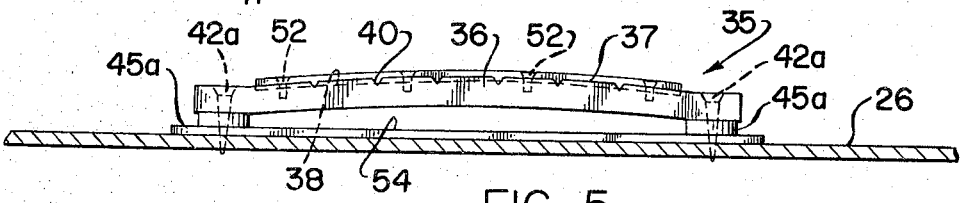
FIG. 5

FLOATING BRIDGE FOR STRING INSTRUMENTS

BACKGROUND OF THE INVENTION

1. Field of the Invention

This invention relates to string instruments, and more particularly to a unique floating-bridge device which generates an unobstructive resonant sound to the body of the instrument. This has not been possible with conventional bridge systems.

2. Description of the Prior Art

As is well known in the art, various problems and difficulties are encountered in providing a high volume of true resonant response from the radiating vibrations of a string instrument.

Several types of devices have been tried and are in use at the present time in an attempt to establish true resonant tones with acceptable volume outputs. However, these devices have features that restrict their use, and they are complicated to operate and maintain. The majority of such devices are electronic in nature, or must rely on electronic accessories.

In contrast to the herein-disclosed floating bridge, there are two well-established bridge structures. One is referred to as the "pressure bridge" and the other as the "tension bridge".

The pressure bridge is one that is mounted under tensioned strings that are secured and fixed at one end and stretched across the bridge member to a second securing-and-tensioning device. Thus, the bridge, and through it the belly, are then subjected to a vertical pressure from the strings downward forces.

In the tension bridge, the strings are attached directly to the bridge unit, which is glued to the belly. The pull of the strings is sustained by the bridge alone, instead of by a separate anchorage beyond the bridge.

Thus, there is a need for a simple device such as the herein-disclosed floating bridge.

SUMMARY OF THE INVENTION

In accordance with the invention as herein disclosed, a new and improved bridge device for string instruments is provided which is secured to a plurality of strings after the strings have been mounted to the instrument, whereby the bridge placement is adjustable with respect to the positioning of the strings.

It is an important object of the invention to provide a bridge device for the associated strings, whereby the bridge is not affected by the longitudinal stress of the strings. In the arrangements herein established, the longitudinal forces are applied between the tuning pegs and the string holder, defined as an adjustable tailpiece, when the strings are tightened to their working tension. The bridge device of this invention is adjustable in height to the position of the strings and is secured thereto. Thus, the bridge and its supporting post are then subjected to a vertical pressure from the strings, ensuring sensitivity of response to their vibrations. Accordingly, the present invention is adapted for use with many known string instruments such as various types of guitars, mandolins, banjos, citterns, etc.

It is another object of the invention to provide a floating-bridge device of this character that includes a bridge block having at least one clamping bar, whereby the strings are tightly secured to the block member. The bridge block is mounted to a very flexible wall or diaphragm by means of at least one supporting post.

Another object of the invention is to provide a device of this character that is readily adjustable between the soundboard and the strings, in order to establish the maximum transfer of vibration.

A further object of the invention is to provide a device of this character that allows a string instrument, particularly a guitar, to be built without strut-support members attached to the soundboard wall of the instrument's belly, the longitudinal stress of the tensioned strings being applied between the neck member and the rear-end wall of the instrument's belly or housing.

Still a further object of the invention is to provide a device of this type having few operating parts.

It is still a further object of the invention to provide a bridge system of this type that is relatively inexpensive to manufacture, and easy to maintain.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only:

FIG. 1 is a perspective view of a guitar having the invention shown mounted thereto;

FIG. 2 is a cross-sectional view taken substantially along line 2—2 of FIG. 1;

FIG. 3 is an exploded view of the floating-bridge device having two adjustable end posts;

FIG. 4 is an enlarged cross-sectional view taken substantially along line 4—4 of FIG. 2;

FIG. 5 is a sectional view similar to FIG. 4, showing the device secured to the soundboard by wood screws;

DESCRIPTION OF THE PREFERRED EMBODIMENT

Figure 6:
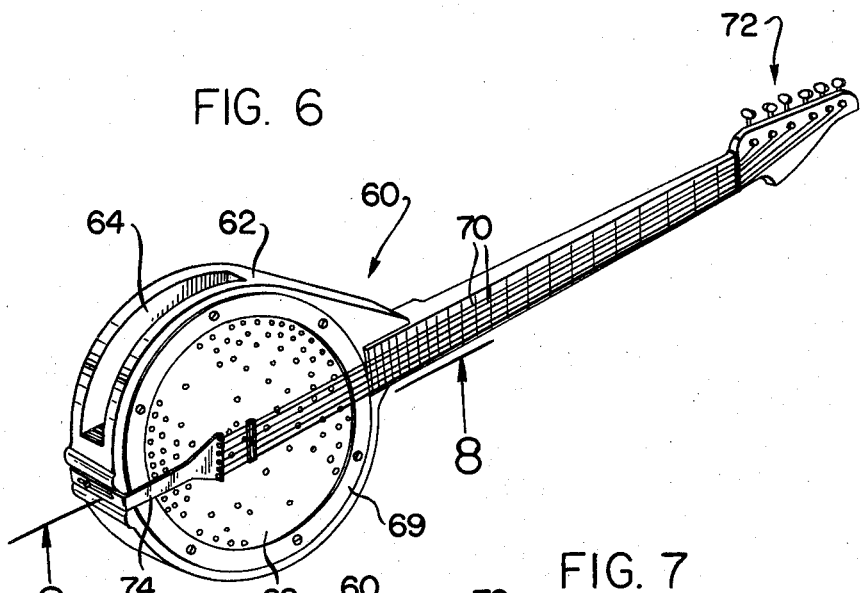
FIG. 6 is a perspective view of another embodiment of the invention, wherein the soundboard is a cone-shaped diaphragm and wherein the bridge device includes a floating support post and pedestal.
Figure 7:
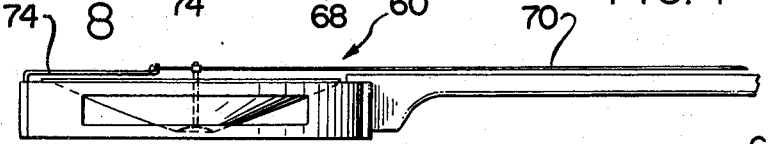
FIG. 7 is a side-elevational view of the above embodiment.
Figure 8:
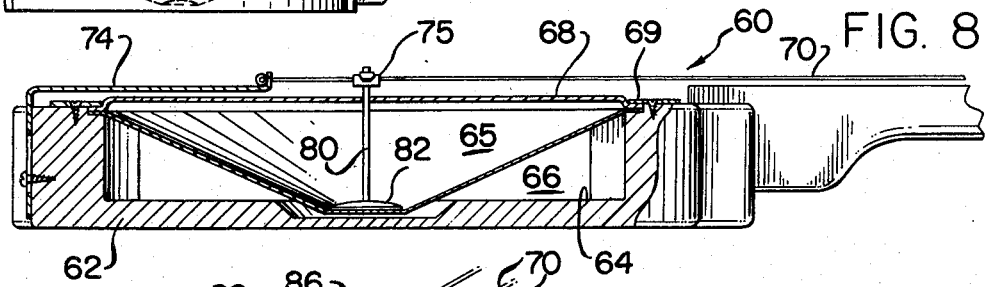
FIG. 8 is an enlarged cross-sectional view taken substantially along line 8—8 of FIG. 6.

Referring first to the embodiment illustrated in FIGS. 1 through 5 and more particularly to FIG. 1, there is shown a string instrument, generally indicated at 10. This instrument is known as a guitar having a hallow body or belly 12 to which is mounted a handle 14, better known as a neck member. The neck member 14 is provided with a fingerboard 16 which is fretted. That is, fingerboard 16 is set with a number of raised markers 18, usually spaced at semitone intervals along the fingerboard under the longitudinally exposed strings 20, the strings being disposed above frets 18 so that each fret acts as an auxiliary nut when the string is pressed against it. A plurality of strings are stretched from the end of the neck member 14, across belly 12, and attached at the neck end by a tuning means 21 and an adjustable attaching means shown as a tailpiece 22 which is secured to the rear-end structure of the belly or body 12. Thus, the strings are adjustable vertically and longitudinally—vertically to allow the proper vibration when plucked and longitudinally to establish the proper tone to each individual string.

Accordingly, the body or belly defines a hollow housing comprising a bottom wall 23 reinforced by cross bars 24 glued thereto. These bars serve as girder stiffeners which prevent the belly from sinking under pressure of the strings, while still preserving general flexibility and response.

However, as shown in FIG. 2, the upper wall 26 is not provided with cross-bar members, thus allowing wall 26 to act as a flexible diaphragm for greater transfer of resonant vibrations.

The upper and bottom walls 26 and 23, respectively, are supported by a side wall 28 to which the tailpiece 22 is secured. If the air space 30 thus enclosed is to resonate freely with the surrounding atmosphere, it is usual to cut a sound hole 32 through the diaphragm 26.

As heretofore stated, the present invention is to provide a purer high volume of responsive resonated sound or tone in a string instrument. This is accomplished by providing a floating bridge, generally indicated at 35, which is mounted to the upper wall or diaphragm 26 and is positioned between the tailpiece 22 and the sound hole 32, generally adjacent the tailpiece as shown in the accompanying drawings.

Figure 11:
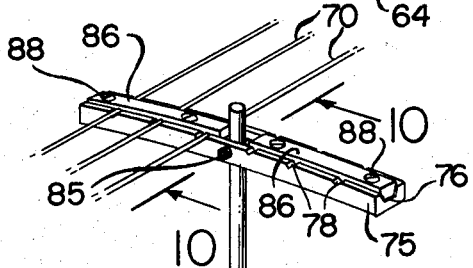
FIG. 11 is an enlarged cross-sectional view of the bridge block taken substantially along line 11—11 of FIG. 4.
Figure 11:
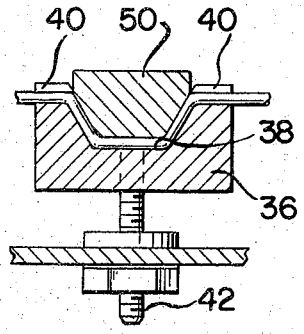
Figure 9:
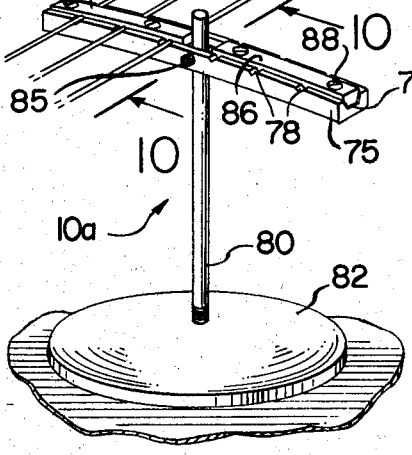
FIG. 9 is a perspective view of the alternative arrangement of the floating-bridge device.

In the first embodiment, the floating-bridge device comprises a bridge block 36 having a longitudinal channel 38 formed therein, as seen in FIG. 11. Transversely disposed across the upper surface 37 of block 36 are a plurality of grooves 40, the number of which is determined by the number of strings employed by a particular string instrument. Thus, six grooves are shown so as to accommodate the six strings of guitar 10. It should also be noted that the bridge block 36 is formed with an arcuate end-to-end body to further correctly position the associated strings 20.

Bridge block 36 is mounted to the soundboard 26 which acts as the resonant diaphragm. An adjustable mounting means is provided which allows the bridge block to be adjusted to the set height of the strings. It is important to note that strings 20 are mounted, as heretofore described, prior to attaching the bridge block; and thus the bridge block and the connected soundboard 26 are not subjected to the lateral forces of the tensioned springs.

In the arrangement as illustrated in FIGS. 1 through 4 and 11, the mounting means comprises a pair of threaded post members 42 which are received in threaded bores 44 formed in the opposite ends of bridge 36. In order to adjust bridge 36 to its proper height, a foot nut 45 is screwed into each post at a point that allows strings 20 to rest within corresponding grooves 40. Posts 42 are positioned in holes 46 disposed in soundboard 26, as seen in FIG. 4, whereby the free ends of posts 42 extend below the soundboard and are secured by washer and nut 47 and 48, respectively, to the soundboard.

After the bridge is secured in position with respect to the strings, a clamping means defined by a clamping bar 50 is placed over strings 20 and clamped to hold them in place. The clamping bar 50 is tightened against strings 20, as seen in FIG. 11, whereby each string is secured in channel 38. Thus, when strings 20 are plucked, the vibration is transmitted to the floating-bridge block 36 and down the posts 42, causing a direct reaction on the diaphragm-acting soundboard 26. Since there are no lateral forces applied to the floating-bridge structure or to the upper wall 20 (soundboard), it will vibrate more readily, thus causing the resonant air space 30 to resonate more freely and affecting the surrounding atmosphere, so that a much louder and clearer tone is projected therefrom than is possible with known bridge systems.

Referring to FIG. 5, the mounting means is illustrated as comprising a pair of mounting posts **42*a* defined by wood screws that secure bridge 36 to the soundboard. In order to adjust the bridge block to the proper position, foot pads 45*a* are interposed between the soundboard and the bridge block. Thus, by changing the thickness of foot pads 45*a*, the bridge block can be raised or lowered as required. Further, if the wall structure of soundboard 26 is too thin, an additional wood strip 54 can be glued thereto to provide sufficient thickness for screws 42*a***.

Referring now to the alternative embodiment as illustrated in FIGS. 6 through 10, there is shown a banjo-like string instrument, generally designated at 60, having a body or belly member 62 formed with a cavity 64 in which a soundboard 65 is positioned, the soundboard being formed from a cone-shaped diaphragm which covers the cavity 64 and thus establishes an air space 66 therebetween. To project the coned diaphragm 65, there is provided a cover plate 68 which is suitably mounted to body 62 by mounting ring 69.

Strings 70 are typcially mounted to the instrument by stretching them between tuning pegs 62 and the tailpiece 74, whereby strings 70 are placed under a pre-tension condition prior to connecting and adjusting the floating-bridge device **10*a***.

Figure 10:
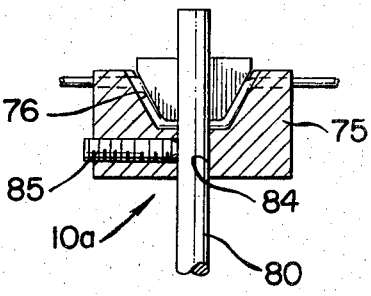
FIG. 10 is an enlarged cross-sectional view of the bridge block taken substantially along line 10—10 of FIG. 9.

In this arrangement, the floating-bridge device **10*a* comprises a bridge block 75 having a longitudinal channel 76, and a plurality of grooves 78 to correspond to the number of strings 70. The means for adjusting the bridge block 75 comprises a central-support post 80 which is mounted to the diaphragm 65 by a pedestal member 82 made of wood or metal, but preferably aluminum for better vibration characteristics. Post 80 extends upwardly through cover 68 to terminating end generally above the strings 70; and the post is received through bore 84 formed centrally in block 75 and locked into position by a set screw 85 located in block 75, so that post 80 is engaged as shown in FIG. 10**.

After the bridge block 75 is positioned to allow strings 70 to rest in grooves 78, clamping bars 86 are secured in channel 76 by screws 88, set screw 85 being locked against post 80.

Accordingly, as the strings are plucked, the vibration therefrom is transmitted through the floating bridge system, and causes the diaphragm 65 to oscillate therewith—producing volume and tone color not obtainable in conventional string instruments. Thus, it can be understood that lateral or transverse vibrations across the bridge are not impeded by longitudinal tensions placed on the strings.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A floating-bridge device for string instruments and combined therewith to generate a high volume of responsive resonated sound from the hollow body of the instrument, said device comprising:

a bridge block attached to the strings under tension defined by an elongated member having a longitudinal channel formed therein, and a plurality of transversely disposed grooves adapted to correspond to and receive said strings therein;

a clamping means secured to said bridge block, whereby said strings are clamped therebetween;

wherein said clamping means comprises at least one clamping bar to fit within said channel of said bridge block, said clamping bar being secured thereto to clamp said strings between said clamping bar and said block, whereby said floating-bridge device transmits the vibration from said strings to said soundboard, without interference from the longitudinal tension of said strings;

means for mounting said bridge block to the flexible soundboard of said hollow body of said instrument, wherein vertical tension of the strings is prevented, said mounting means comprising:

at least one vertical post member, one end of which is attached to said soundboard and the opposite end is connected to said bridge block; and means thereon for adjusting said bridge block in a vertical direction, whereby said bridge block engages said strings.

2. A floating-bridge device as recited in claim 1, wherein said mounting means includes a pair of post members mounted at opposite ends of said bridge block.

3. A floating-bridge device as recited in claim 2, wherein said post members are threaded, and wherein said adjusting means comprises:

a foot pad threadably adjustable along said post members to a selected position thereon, said foot pad engaging the upper surface of said soundboard; and a nut member mounted to said threaded post on the underside of said soundboard, whereby said soundboard is interposed therebetween for positive transfer of the resonant vibrations.

4. A floating-bridge device as recited in claim 2, wherein said post members are screws adapted to be secured to said soundboard, and wherein said adjusting means comprises a foot pad having a predetermined thickness, said foot pad being interposed between said bridge block and said soundboard.

5. A floating-bridge device as recited in claim 1, wherein said soundboard defines a diaphragm.

6. A floating-bridge device as recited in claim 5, wherein said mounting means comprises:

a vertical-post member adapted to adjustably receive said bridge block thereon; and a pedestal secured to the lower end of said post member, and supported on said diaphragm.

7. A floating-bridge device as recited in claim 6, wherein said diaphragm is cone-shaped.

8. A floating-bridge device as recited in claim 6, wherein said adjusting means comprises a set screw mounted in said bridge block, to engage said post member at a selected location thereon.

* * * * *